US005449159A

United States Patent [19]

Belec et al.

[11] Patent Number: 5,449,159

[45] Date of Patent: Sep. 12, 1995

[54] ON EDGE ENVELOPE STACKING APPARATUS WITH ADJUSTABLE REGISTRATION SURFACE

[75] Inventors: Eric A. Belec, Southbury; William D. Toth, Milford, both of Conn.

[73] Assignee: Pitney Bowes Inc., Stamford, Conn.

[21] Appl. No.: 152,790

[22] Filed: Nov. 15, 1993

[51] Int. Cl.[6] ..... B65H 5/00

[52] U.S. Cl. ..... 271/2; 271/215; 271/219; 271/178; 271/224

[58] Field of Search ..... 271/215, 219, 223, 224, 271/177, 178, 2

[56] References Cited

U.S. PATENT DOCUMENTS

| | | | |
|---|---|---|---|
| 3,420,518 | 1/1969 | Eveland | 271/223 X |
| 3,828,634 | 8/1974 | Luperti | 271/2 X |
| 3,865,365 | 2/1975 | Hardin | 271/178 X |
| 4,524,965 | 6/1985 | Kulpa | 271/219 X |
| 4,623,140 | 11/1986 | Allio | 271/177 X |
| 4,718,660 | 1/1988 | Daboub | 271/177 |
| 4,778,062 | 10/1988 | Pavie | 209/546 |
| 4,863,037 | 9/1989 | Stevens . | |
| 4,991,914 | 2/1991 | Kerstein | 312/319 |
| 5,119,954 | 6/1992 | Svyatsky . | |
| 5,201,504 | 4/1993 | Fallos | 271/2 |
| 5,224,697 | 7/1993 | Darchis . | |
| 5,233,814 | 9/1993 | Bergerioux | 53/536 |
| 5,244,344 | 9/1993 | Doeberl et al. . | |
| 5,245,547 | 9/1993 | Ramsey . | |

*Primary Examiner*—H. Grant Skaggs
*Assistant Examiner*—Carol L. Druzbick
*Attorney, Agent, or Firm*—Charles R. Malandra, Jr.; Melvin J. Scolnick

[57] ABSTRACT

In accordance with the present invention apparatus for stacking flat articles, such as envelopes, on edge, comprises structure for transporting the envelopes on edge along a transport path and a deck plate having an upper side adjacent the transport path. A vertical registration wall, which is mounted on the deck plate, defines a stacking bin in which the envelopes are stacked. A deflector, which is situated between the transporting structure and the stacking bin, pivots between a first and second position, wherein the first position allows the envelopes to be transported past the stacking bin and the second position deflects the envelopes into the stacking bin. There is an urge roller, located in the stacking bin between the deflector and the registration wall for urging the envelopes towards the registration wall. There is a spring loaded paddle slidably positioned in the stacking bin orthogonal to the registration wall and above the deck surface, for urging the stacked envelopes toward the urge roller. The registration wall is positioned for a particular size envelope such that a trail edge length of the envelope is approximately 1½ inches, the trail edge length being the distance between the trail edge of the envelope and the engagement point of the urge roller to the envelope when the lead edge of the envelope is against the registration wall.

5 Claims, 5 Drawing Sheets

ON EDGE ENVELOPE STACKING APPARATUS WITH ADJUSTABLE REGISTRATION SURFACE

FIELD OF THE INVENTION

The invention disclosed herein relates generally to apparatus for stacking mailpieces, and more particularly to apparatus for on-edge stacking of mailpieces.

RELATED APPLICATIONS

The present application is related to U.S. applications Ser. Nos. 08/152,802, 08/152,791, 08/152,793 and 08/152,789, filed concurrently herewith, and assigned to the assignee of the present invention.

BACKGROUND OF THE INVENTION

Conventional "on-edge" mail stacking devices are usually composed of a transport followed by various forms of stacking mechanisms. Generally, multi-bin on-edge stacking devices include gating mechanisms which divert specific mailpieces, i.e. envelopes, into predetermined stacker bins. The lead edge of the mailpieces are urged against a fixed registration surface in the bin. Such on-edge stacking devices are well known. The overwhelming majority of these devices stack mailpieces received in a vertical orientation on a horizontal surface.

Typically, in an on-edge stacking device envelopes are transported vertically along a dual belt transport system, deflected into a stacker bin by a deflector mechanism, and guided into the bin by conventional guide and urging components. The envelopes always stop against some sort of vertical registration surface. Since on-edge stackers currently used in mail sorting applications typically process a variety of envelope sizes concurrently, this vertical registration surface must be located in a compromise position to satisfy the requirement of both small envelopes (6" long) as well as large envelopes (12" long).

If conventional on-edge stackers are interfaced to the output of inserters, the stacking reliability suffers because such stackers are structured to handle a variety of envelope sizes. However, inserters process one size envelope at a time, rather than the concurrent processing of envelopes ranging from 6" to 12" in length. As a result, the reliability of on-edge stacking of envelopes output by an inserter suffers.

It is an object of the present invention to provide a simple stacking device which yields highly reliable stacking of any size envelope output from an inserter.

SUMMARY OF THE INVENTION

The present invention is an improvement to conventional on-edge stacking devices. The present invention will ensure a better "quality" of envelope stack, resulting in fewer stacker jams and, therefore, much greater stacker reliability.

The present invention provides a simple way to optimize the registration geometry associated with each stacker bin which improves the overall operation and performance of the device.

In accordance with the present invention apparatus for stacking flat articles, such as envelopes, on edge, comprises means for transporting the envelopes on edge along a transport path and a deck plate having an upper side adjacent the transport path. A vertical registration wall, which is mounted on the deck plate, defines a stacking bin in which the envelopes are stacked. A deflector, which is situated between the transporting means and the stacking bin, pivots between a first and second position, wherein the first position allows the envelopes to be transported past the stacking bin and the second position deflects the envelopes into the stacking bin. There is an urge roller, located in the stacking bin between the deflector and the registration wall for urging the envelopes towards the registration wall. There is a spring loaded paddle slidably positioned in the stacking bin orthogonal to the registration wall and above the deck surface, for urging the sacked flat envelopes toward said urge roller. The registration wall is positioned for a particular size envelope such that a trail edge length of the envelope is approximately 1½ inches, the trail edge length being the distance between the trail edge of the envelope and the engagement point of the urge roller to the envelope when the lead edge of the envelope is against the registration wall.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
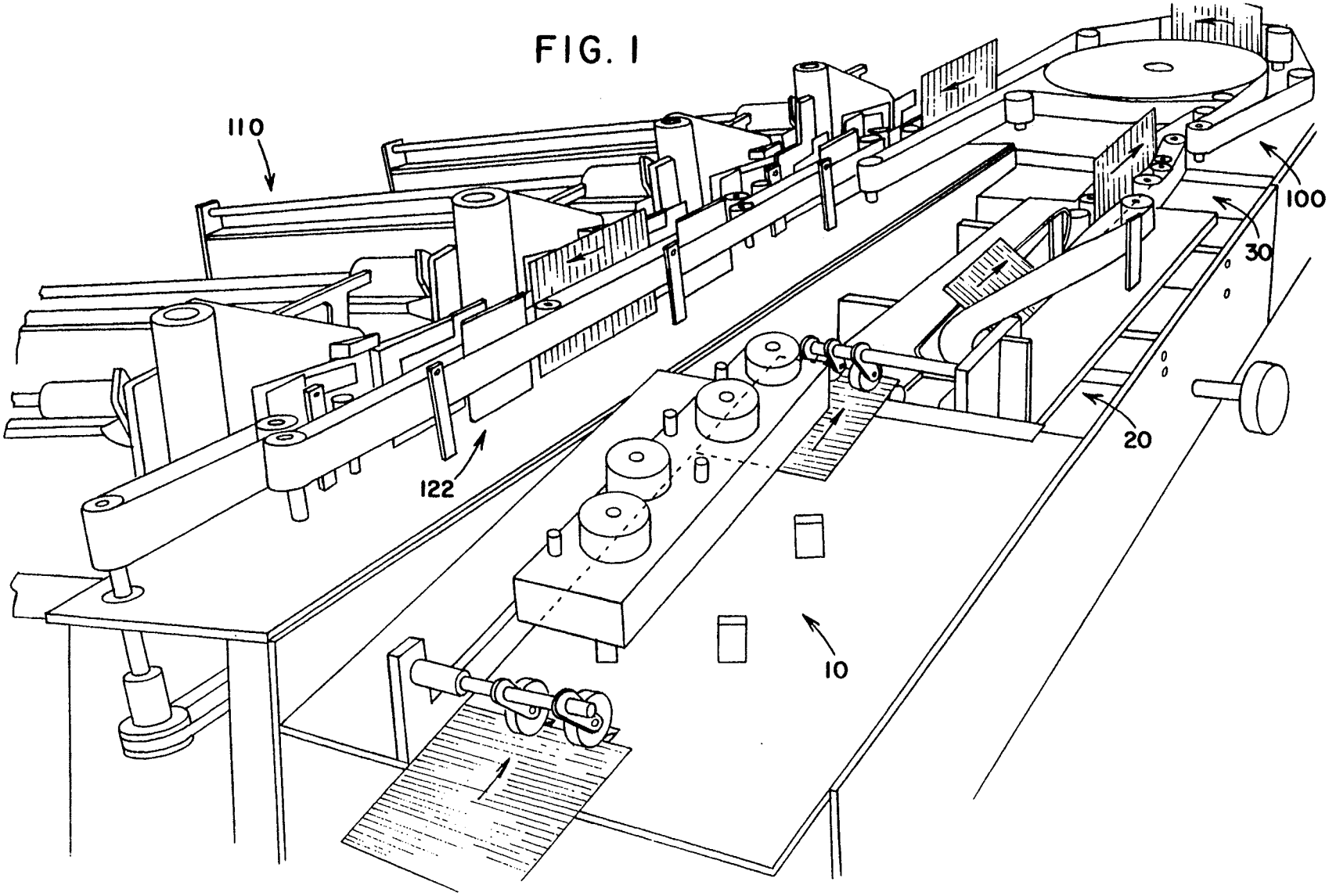
FIG. 1 is a perspective view of apparatus including the stacking device in accordance with the present invention.
Figure 2:
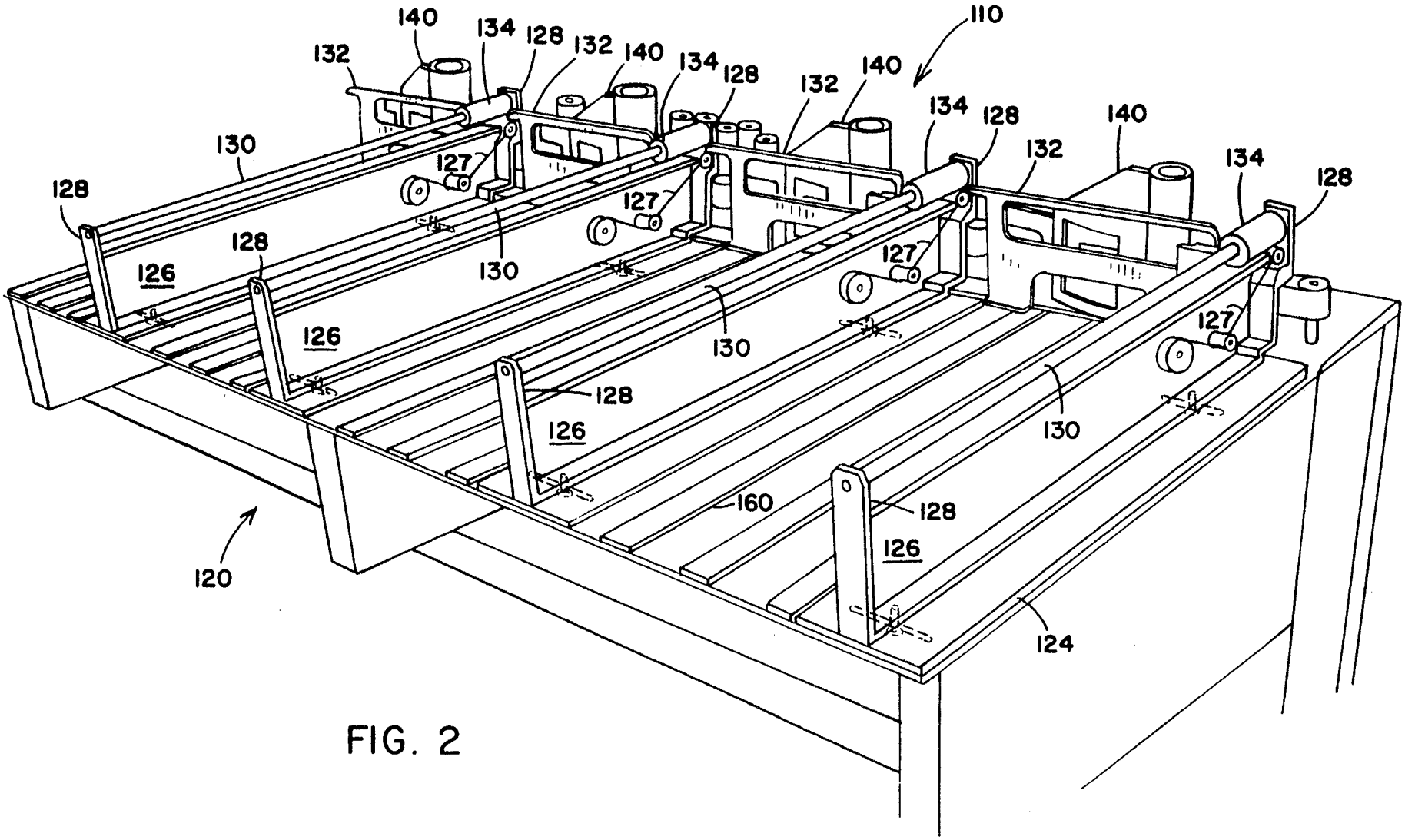
FIG. 2 is a perspective view of the stacking device in accordance with the present invention.
Figure 3:
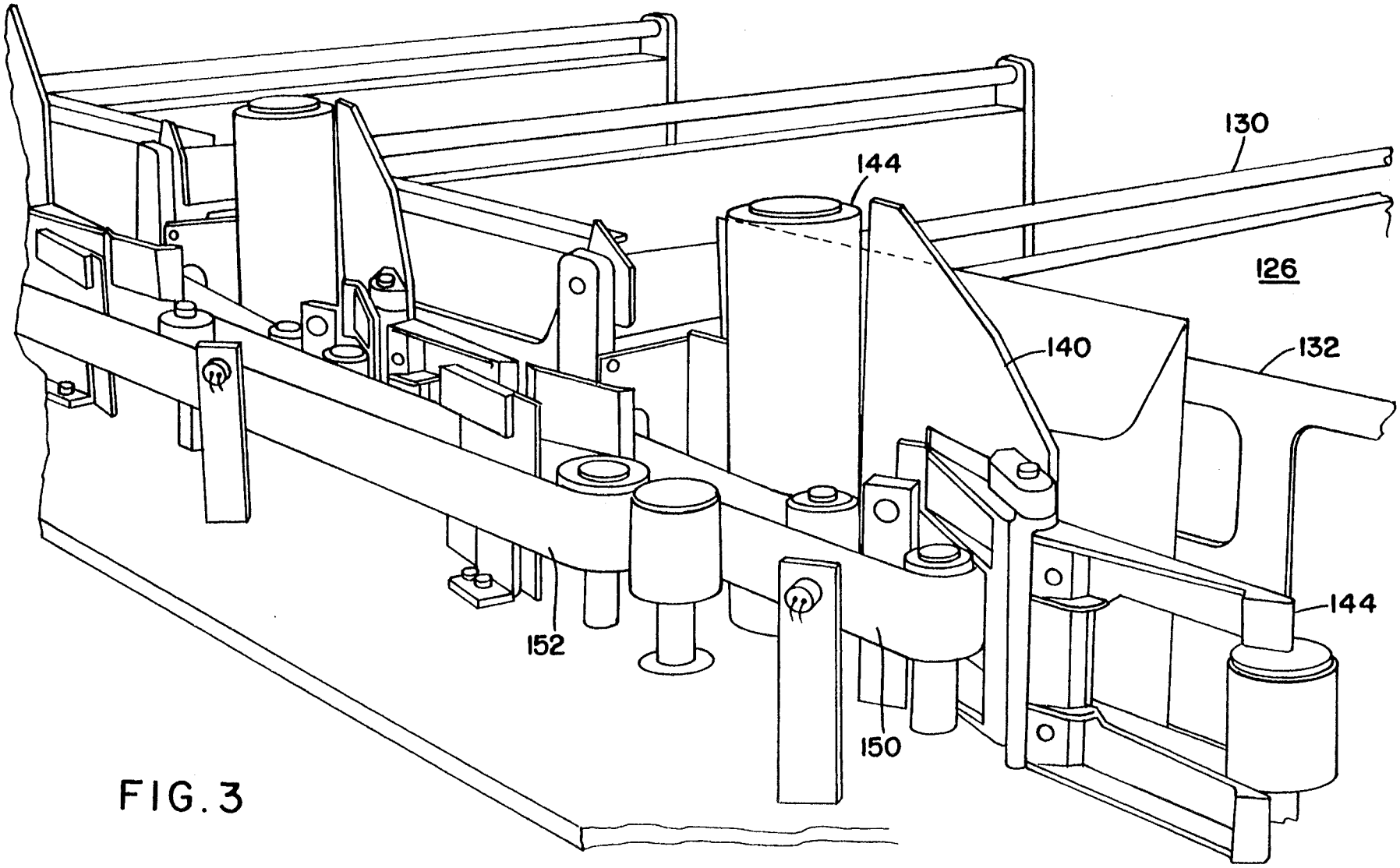
FIG. 3 is a perspective view of the stacking device of FIG. 1 showing a large envelope stacked against a fixed registration wall.

In describing the present invention, reference is made to the drawings, wherein there is seen in FIG. 1 a series of modules that are connected to perform on-edge stacking of mailpieces assembled in an inserter or other mail finishing equipment. A top-edge alignment module 10 is connected to the output end of an inserter (not shown). Module 10 receives mailpieces from the inserter in a horizontal orientation, maintains top-edge registration of the mailpieces and delivers the mailpieces to a turn-up and alignment module 20 which is coupled to the output end of alignment module 10. Turn-up and alignment module 20 is adjustably positioned to obtain bottom-edge registration of the mailpieces while turning the mailpieces 90 degrees to a vertical orientation. Coupled to the exit of turn-up and alignment module 20 is a stationary vertical transport 30 which transports the mailpieces to a drum transport 100. Drum transport 100 is a vertical transport that moves the mailpieces along a U-shaped path to a stacker module 110. A more detailed description of turn-up and alignment module 20 and the transporting of the mailpieces from the inserter to stacker 110 is disclosed in U.S. patent applications Ser. Nos. 08/152,802, now U.S. Pat. No. 5,368,283, and 08/152,793, now U.S. Pat. No. 5,411,250, previously noted as related application, and hereby incorporated by reference.

Referring now to FIGS. 2–6, stacker 110 includes a plurality of bins, generally designated 120, and a vertical transport, generally designated 122 (FIG. 1). Bins 120 include an base plate 124 and a plurality of registration walls 126 that are mounted to base plate 124. Registration walls 126 divide base plate 124 into separate bin sections. In the preferred embodiment of the present invention, four registration walls 126 are mounted at certain intervals along base plate 124 to make four separate bins. Each of registration walls 126 include a pair of end members 128 having a section thereof extending above the top of registration wall 126. Each registration wall 126 has a bar 130 that longitudinally extends above the top of the wall and is mounted to the pair of end members 128. A paddle 132 is slidably mounted on each of bars 130. Paddle 132 includes at one end a cylinder-shaped member 134 that is orthogonal to the flat section 136 of paddle 132. Cylinder member 134 includes an aperture through which Paddle 132 is slidably mounted on bar 130. In addition to moving up longitudinally along bar 130, paddle 132 can pivot (not shown) about bar 130 allowing the removal of a stack from the corresponding bin 120.

Paddle 132 is spring loaded on bar 130. The size of the spring 127 is critical in the present invention. A spring that is suitable for handling stacks of large envelopes that may weigh as much as 25 pounds, would provide too much resistance during the stacking of small envelope, the stack of which may be as little as 6 pounds. The converse is true for springs suitable for handling small stacks. In the preferred embodiment of the present invention, a nonlinear spring force from 8 ounces to 2 pounds can be used. For example, a commercially available spring reel can be used, such as ML-3949 manufactured by Ametek of Hatfield, Pa.

Each bin 120 further includes a lead-in guide plate 140 and a guide surface 142. An urge pulley 144 is sandwiched between guide plate 140, guide surface 142 and transport belt 150. Each bin 120 also has a gate 146 which is actuated by a destinations signal from a control system for stacker 110. Gate 146, when actuated, temporarily intersects transport 122 to thereby divert an envelope from the transport 122 into the bin 120.

Vertical transport system 122 is a dual belt system comprising a plurality of inner belt sections 150 and outer belt sections 152. Inner and outer belt sections 150 and 152 include conventional drive and idler pulleys around which endless elastic belts are stretched. Gates 146 are located between inner belt sections 150, adjacent to the inner reach of outer belt sections 152 and extend parallel to the transport path of vertical transport system 122. Gates 146 pivot at one end about a vertical axis. Each of gates 146 include a rectangular open section 145 in the non pivoting end through outer belt 152 travels when gate 146 pivots thereto. Outer belt section 152 is shown with multiple belts. In an alternate embodiment (not shown) a single outer belt transport is used in place of multiple outer belt sections 152. The single belt transport includes strategically placed idler pulleys which deflect the mail path to provide lateral force between the belts.

In accordance with the present invention, low abrasive strips 160 are longitudinally fastened to the surface of base plate 124. As is described below, strips 160 must have a low coefficient of friction. In the preferred embodiment of the present invention, strips 160 are made of Delrin AF, manufactured by DuPont of Wilmington, Del. Strips 160 act as the deck of bins 120 as envelopes are stacked into bins 120.

With the structure having been disclosed, the operation of stacker 110 is set forth. An envelope is conveyed to stacker 110 from the upstream modules 10, 20, 30 and 100. As the envelope is transported on edge by vertical transport system 122, the control system for the stacker causes a gate 146 of a bin 120 to deflect momentarily toward the adjacent outer belt. This causes the envelope to deflect off gate 146 and follow guide plate 140. The lead edge of the envelope hits the previously stacked envelope (or paddle 132 if the bin is empty) and urge roller 144 urges the envelope between guide surface 142 and the previously stacked envelope until the lead edge of the envelope hits registration wall 126.

The present invention can be used in a stacking device that does not need a mechanism to perform the traditional "stack advance" function. Instead, the entire stacker bin is angulated at a specific angle. This allows gravity to act on the stack of mailpieces being accumulated in the stacker bin and advance the stack as additional pieces enter. There are certain very specific conditions which allow such stacking device to be successful while stacking a great variety of different types of envelopes to stack lengths of 22" or greater. A more detailed description of such a stacking device is provided in U.S. patent application Ser. No. 08/152,791, previously noted.

It has been found that the most significant parameter influencing stacker effectiveness is the distance from the trail edge of an envelope to the engagement point of an urging device, such as friction roller 144, after the lead edge of the envelope has come to rest against the vertical registration surface, i.e. registration wall 126. This distance is referred to herein as "trail edge length". It has also been found that the minimization of the length between the trail edge of the envelope and the urging device gives the most optimal stacking results. By minimizing the "trail edge length", the trail end of the envelope will not tend to hang up or deform as the envelope is directed into the stacking bin. This will result in much better stacking quality.

Although the minimization of the "trail edge length" is highly desirable, it can not be reduced beyond a certain limit. If the trail edge length is reduced too much, the lead edges of incoming envelopes will crash into the trail edges of previously stacked envelopes and create jam conditions. For this reason conventional stacking devices have not been able to optimize their "trail edge length" because they have to stack both long and short envelopes concurrently. In other words, the physical geometry of the conventional stackers must be set up to provide a sufficient "trail edge length" for a 6" long envelope. Consequently, the "trail edge length" for all envelopes greater than 6" in length is increased according to the specific envelope length. For example, an existing stacker with a "trail edge length" of 1.5" for a 6" envelope (FIG. 4) would have a "trail edge length" of 5" for a #10 envelope (FIG. 5) simply due to the extra 3.5" length of the #10 envelope beyond that of the 6" envelope. Although such a large "trail edge length" certainly has undesirable effects on the quality of stacking #10 envelopes, conventional on-edge stacking devices are limited in this respect.

As an output processing device for a console inserter, a stacking device in accordance with the present invention will be stacking identically sized envelopes during any given production run. Taking this into consideration, the present invention provides the opportunity to optimize the "trail edge length" associated with stacker geometry during each production run regardless of the size envelope being stacked.

Figure 4:
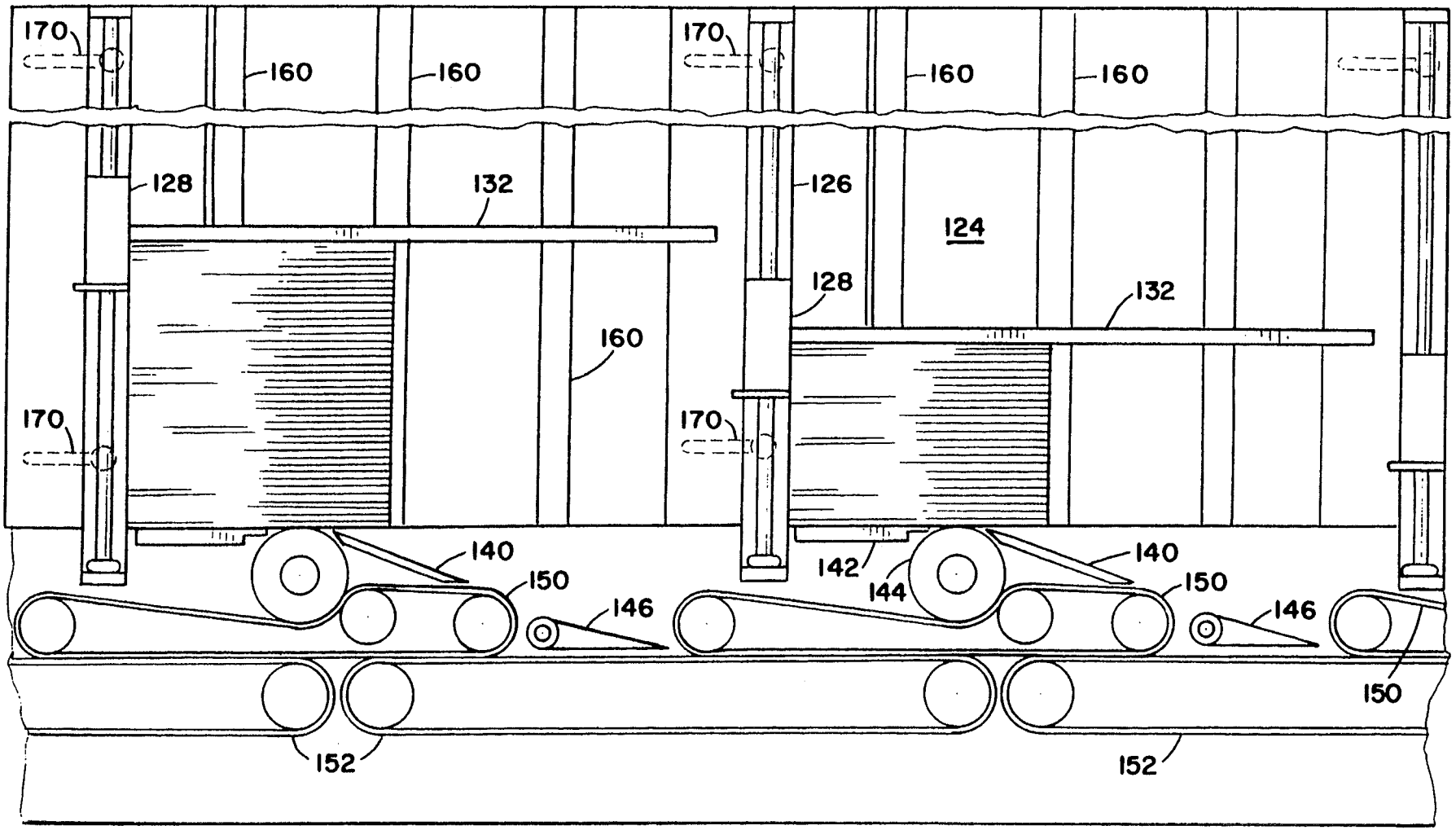
FIG. 4 is a top view of the stacking device of FIG. 2 showing a registration wall positioned of small envelopes.
Figure 6:
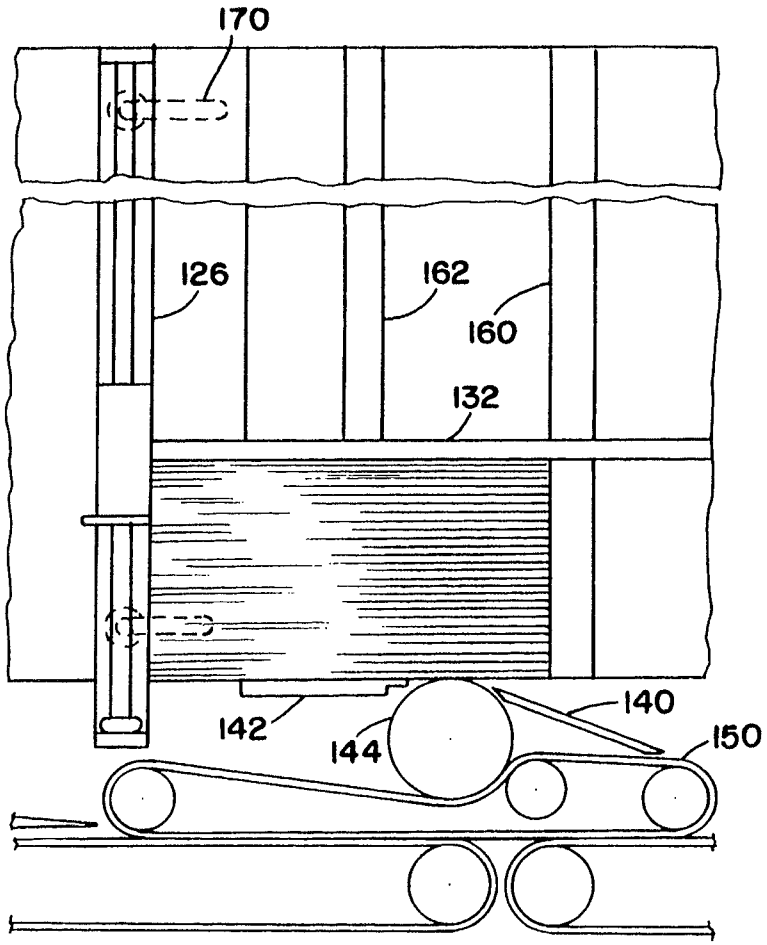
FIG. 6 is top view of the stacking device of FIG. 2 showing the stacking of large envelopes after adjustment of the registration wall.
Figure 5:
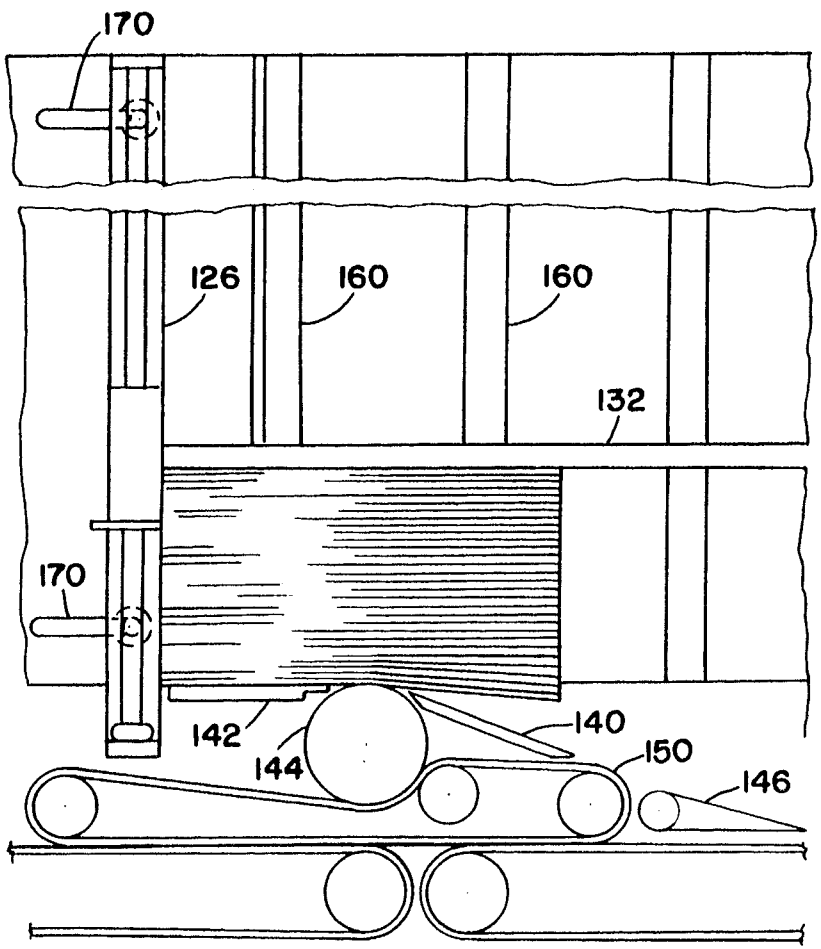
FIG. 5 is a top view of the stacking device of FIG. 2 showing the stacking of large envelopes without adjustment of the registration wall.

In accordance with the present invention, the "trail edge length" may be manipulated to provide the optimal stacking geometry for the envelope size being processed. By including the capability to laterally manipulate the vertical registration wall 126, i.e. to the left or to the right as seen in FIGS. 4–6, the "trail edge length" of envelopes being processed may be increased or decreased. For example, to obtain a 1.5" "trail edge length" for a small envelope, such as a 6" long envelope, will require that the vertical registration wall be positioned to the right to shorten the distance between urge pulley 144 and registration wall 126 (FIG. 4). If a #10 envelope, having a 9.5" length, were stacked in that same arrangement, a 5" "trail edge length" would result producing an undesirable stacking geometry (FIG. 5). Since the #10 envelope would also stack more easily with a "trail edge length" approximating 1.5" registration wall 126 can be moved to accommodate the desired geometry (FIG. 6). The simple manipulation of registration wall 126 provides the means to maintain optimal stacking geometry for a variety of envelope sizes. By incorporating the movable registration wall, a stacker will have improved performance characteristics by reducing the number of jams in the stacking device as well as yielding finished envelope stacks of higher "quality".

The manner by which the vertical registration wall 126 is adjusted can be as simple or as complex as is desired. In the preferred embodiment of the present invention, a simple method to make the registration surface adjustable is to provide multiple sets of lateral slots 170 through which the registration surface can be laterally positioned and secured in a conventional manner. Slots 170 have a length sufficient for registration wall to be positioned over an entire range of desirable positions. An alternate embodiment provides multiple sets of discrete holes that facilitate an easy adjustment of registration wall 126 to several discrete positions for desired "trail edge lengths" of envelopes processed. An alternate and more elaborate means of adjusting the "trail edge lengths" of envelopes in their respective stackers is to provide, in addition to slots 170 f the preferred embodiment, a "lead-screw type" of mechanism to offer an easy operator adjustment and infinitely variable placement of the registration wall across all envelope lengths.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. Apparatus for stacking envelopes, on edge, comprising:

means for transporting the envelopes on edge along a transport path;

a deck plate, having an upper side adjacent said transport path;

a vertical registration wall mounted on said deck plate, said vertical registration wall and said deck plate defining a stacking bin in which the envelopes are stacked, said registration wall extending the length of the stacking bin;

a deflector, situated between said transporting means and said stacking bin, said deflector pivoting between a first and second position, wherein said first position allows the envelopes to be transported past said stacking bin and said second position deflects the envelopes into said stacking bin;

an urge roller, located in said stacking bin between said deflector and said registration wall for urging the envelopes towards said registration wall;

a paddle slidably positioned in said stacking bin, said paddle including a stacking face orthogonal to said registration wall and above said deck surface, said paddle including a spring force toward said urge roller, wherein said stacking face of said paddle is adjacent said urge roller when said bin is empty and moves down said bin as envelopes are stack against said registration wall; and means for laterally adjusting the position said registration wall relative to said urge roller, wherein said registration wall is positioned closer to said urge roller when smaller documents are being stacked and farther from said urge roller when larger documents are being stacked.

2. The apparatus of claim 1 wherein said adjusting means includes means for fastening said registration wall to said deck plate, said fastening means extending through slots in said deck plate.

3. The apparatus of claim 1 wherein said registration wall is positioned for a particular size envelope such that a trail edge length of the envelope is approximately 1½ inches, said trail edge length being the distance between the trail edge of the envelope and the engagement point of said urge roller to the envelope when the lead edge of the envelope is against said registration wall.

4. The apparatus of claim 3, further comprising guide means for guiding the deflected envelopes to said urge roller.

5. The apparatus of claim 4 wherein said transporting means comprises a dual belt, on-edge transport.

* * * * *